US011918092B2

(12) United States Patent
Serlachius

(10) Patent No.: US 11,918,092 B2
(45) Date of Patent: Mar. 5, 2024

(54) NORDIC WALKING/RUNNING/EXERCISE POLE

(71) Applicant: Creaforce Oy, Kauniainen (FI)

(72) Inventor: Fredrik Serlachius, Kauniainen (FI)

(73) Assignee: Creaforce Oy, Kauniainen (FI)

( * ) Notice: Subject to any disclaimer, the term of this patent is extended or adjusted under 35 U.S.C. 154(b) by 130 days.

(21) Appl. No.: 17/421,754

(22) PCT Filed: Jan. 10, 2020

(86) PCT No.: PCT/FI2020/000001

§ 371 (c)(1),
(2) Date: Jul. 9, 2021

(87) PCT Pub. No.: WO2020/144400

PCT Pub. Date: Jul. 16, 2020

(65) Prior Publication Data

US 2022/0022612 A1 Jan. 27, 2022

(30) Foreign Application Priority Data

| | | |
|---|---|---|
| Jan. 10, 2019 | (FI) | 20190002 |
| Jul. 26, 2019 | (FI) | 20190061 |
| Sep. 19, 2019 | (FI) | 20190071 |

(51) Int. Cl.

| | |
|---|---|
| ***A45B 9/02*** | (2006.01) |
| ***A63C 11/22*** | (2006.01) |
| *A45B 9/00* | (2006.01) |

(52) U.S. Cl.

CPC ..... *A45B 9/02* (2013.01); *A63C 11/221* (2013.01); *A63C 11/222* (2013.01); *A45B 2009/007* (2013.01)

(58) Field of Classification Search

CPC ..... A45B 9/02; A63C 11/222

See application file for complete search history.

(56) References Cited

U.S. PATENT DOCUMENTS

| | | | | |
|---|---|---|---|---|
| 4,232,875 | A * | 11/1980 | Klees | A63C 11/2228 280/822 |
| 4,508,364 | A | 4/1985 | Joseph | |
| 4,641,857 | A | 2/1987 | Gailiunas | |
| 6,070,907 | A | 6/2000 | Bujold et al. | |
| 6,491,323 | B1 | 12/2002 | Kustritz | |
| 7,445,016 | B1 * | 11/2008 | Ortiz | A45B 9/02 135/65 |
| 7,896,013 | B2 * | 3/2011 | Lerner | A63C 11/222 135/65 |
| 8,858,401 | B2 * | 10/2014 | Kaupe | A45B 1/02 135/65 |
| 10,098,424 | B1 | 10/2018 | Husted et al. | |
| 2013/0098412 | A1 | 4/2013 | Weber | |

FOREIGN PATENT DOCUMENTS

| | | | |
|---|---|---|---|
| DE | 2806243 | A1 | 8/1979 |
| DE | 102012106085 | A1 | 1/2014 |
| EP | 2135646 | A2 | 12/2009 |
| EP | 3205227 | A1 | 8/2017 |
| FI | 8924 | U1 | 10/2010 |
| KR | 100991485 | B1 | 11/2010 |
| WO | WO2016128628 | A1 | 8/2016 |

* cited by examiner

*Primary Examiner* — Noah Chandler Hawk
(74) *Attorney, Agent, or Firm* — Laine IP Oy

(57) ABSTRACT

The invention is directed to a Nordic walking/running/exercise pole, which is equipped with a handle flexing towards the pole shaft.

5 Claims, 6 Drawing Sheets

Figure 3:
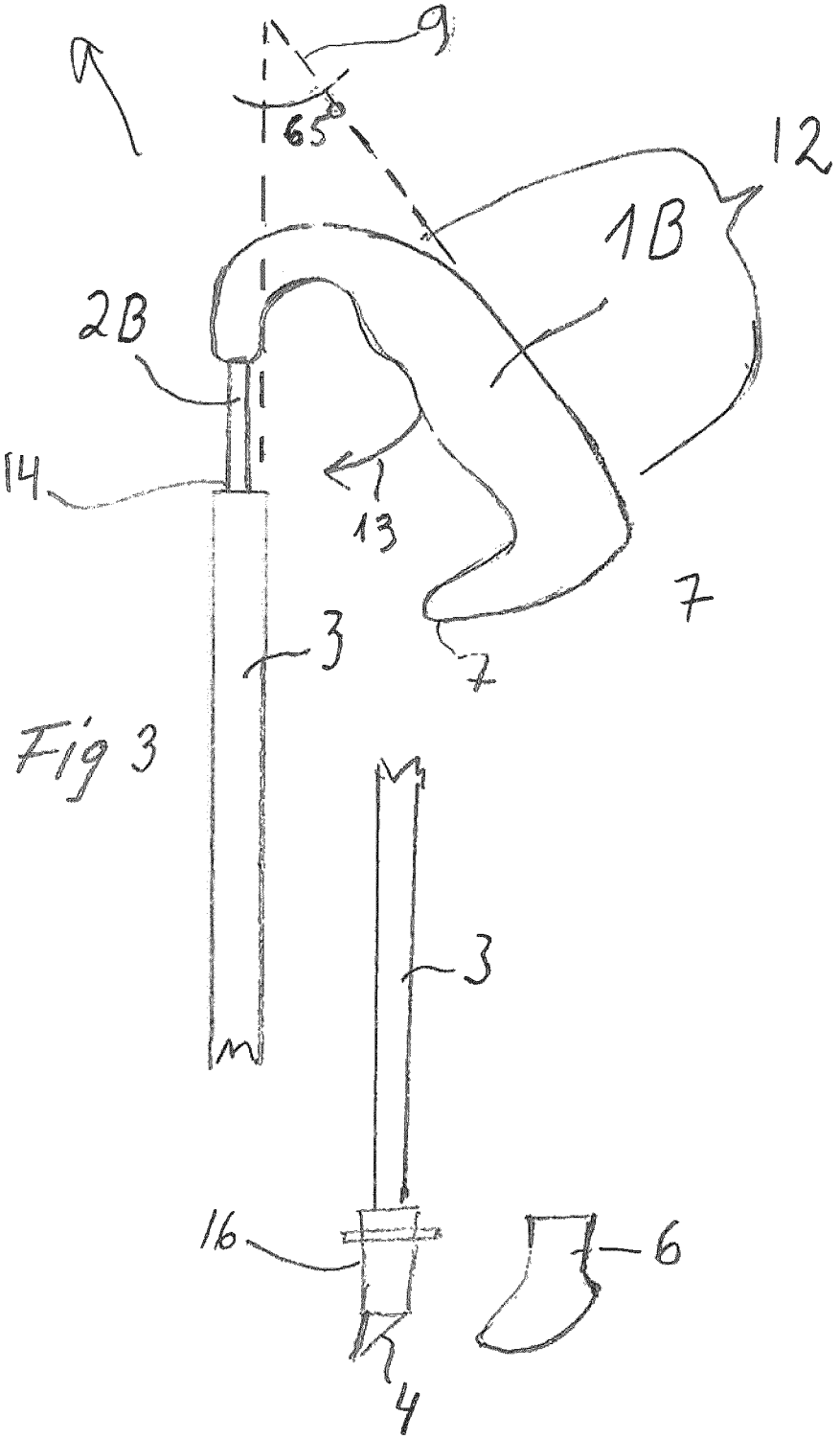

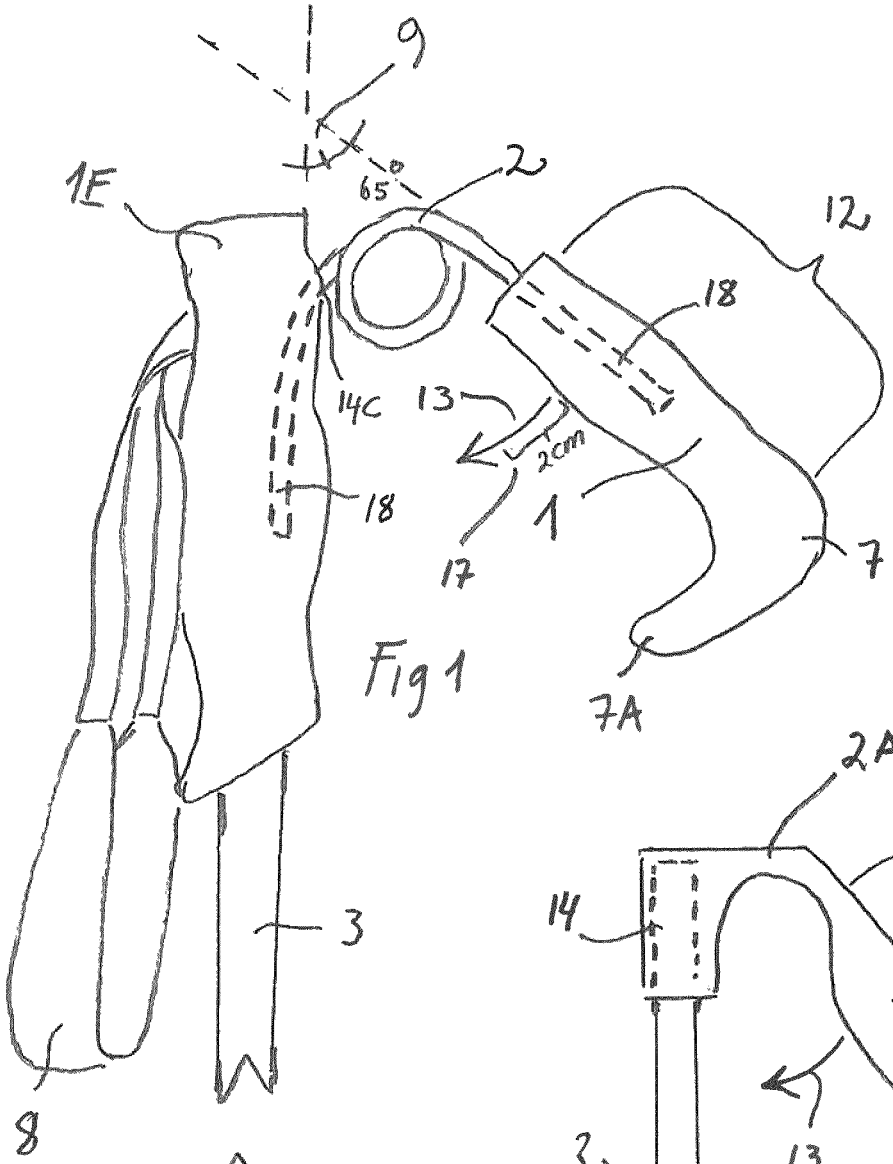
Fig 1
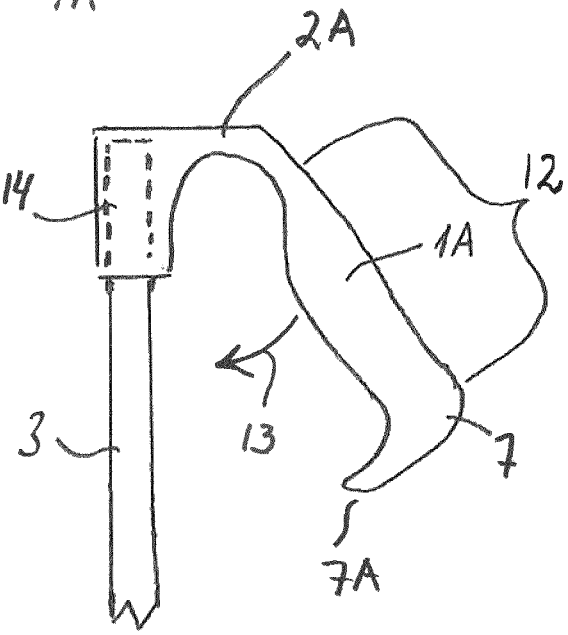
Fig 2
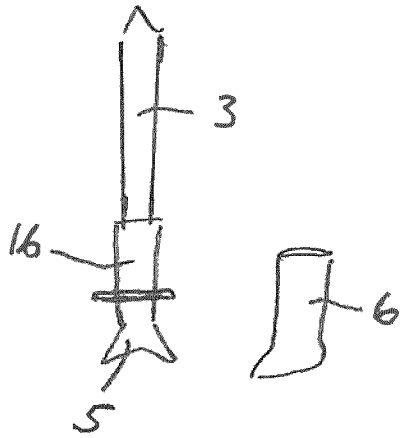
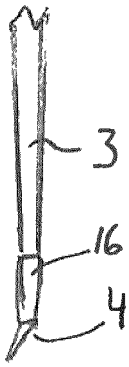

NORDIC WALKING/RUNNING/EXERCISE POLE

The invention comprises a flexing pole, in which the flexing is realised with a handle mounted flexibly at a certain angle to the pole shaft.

In recent years, Nordic walking has become one of the most popular exercise forms for the nation. At the beginning, traditional ski poles were used, but, over time, as more and more exercising people found Nordic walking as an exercise form, it has also been possible to evaluate its benefits as well as its disadvantages. Finns have a centuries-long experience in skiing as an exercise form also used during war. Even when trying to find them, it is not possible to find any disadvantages in it. To the contrary, during cross-country skiing, only using one's own body as a counter weight, the soft touch of the ski poles and skis onto the ground guarantees that no muscle overload or damage is part of cross-country skiing. Instead, experiences in Nordic walking have proven that it is an exercise form of its own with its own characteristics.

When skiing, the purpose of the poles is to push a person on skis forwards, but, as Nordic walking does not require a lot of physical strength occasionally needed when skiing, it is considered more as an overall smooth exercise form for the body. In order for a person's body to stay in the right upright position during Nordic walking, not in the forward stooping position when skiing which keeps the upper body in abnormal tension, during walking, the correct walking technique is to keep the poles behind the body's vertical line, whereupon the pole's motion is a short push backwards, stretching the arms straight when moving them backwards.

The motion of the poles behind the body's vertical line keeps the body naturally in an upright position. As an exercise form, this pendulum and pushing motion of the arms with the poles rises walking to a completely new level as it increases the upper body's physical activity in an ergonomically healthy way.

But, there is nothing so good that there would not also be something bad, a saying people not often dare to say about Nordic walking loved by the Finns. Nevertheless, each time the tip of a Nordic walking pole especially hits a hard surface, it generates a slight shock, which, in the long run, strains joints and ligaments causing minor tissue damage, which may result in chronic inflammation, a fact also claimed, among others, by a scientific study conducted by the Alexander Technique.

The pole shafts in the market are made of carbon fibre, fiberglass, or aluminium, and among their shafts, especially those made of fiberglass are somewhat flexible, but their flexing does not eliminate the detrimental vibration. There are many BungyBump walking pole versions with a telescopic shaft, whose lower shaft part protrudes into the upper shaft part which has a spring, this way making the shaft into a shock absorber, which also eliminates the pole's resistance. If the pole is used in the wrong way, in other words, it is hit onto the ground in front of the body, the shock absorber works at the expense of the resistance, and, in such a case, the pole does not provide the desired support, and when there is no resistance during the pole's pushing phase, the body's natural walking rhythm disappears, and the arm movements become continuous pumping motion of the arms, especially in case of the original BungyBump walking pole, in which the telescopic flexing has intentionally been designed long.

Another adverse effect is caused by the pole straps supporting the wrists that are necessary to complete the pole's motion. The pole's pushing takes place behind the body, in other words, behind the back, in which the final motion is the most important motion when the arm straightens. When correctly performed, this motion takes entirely place supported by the strap, when the pole is in a way pulled back from the strap with an open hand, tightening the strap around the arm that concurrently bends upwards from the wrist joint. Little by little, this repeating motion strains the wrist joint and, in the long run, may result in an inflammatory reaction and pain.

Due to the vibration generated by a traditional, too stiff Nordic walking pole, today's Nordic walking pole is not designed to be especially used for running or walking on a hard surface, in which the stiff, inflexible pole hits the ground with too strong force, even causing damaging thumps.

The purpose of the invention presented here is to remove the problems related to Nordic walking and running especially on a hard surface by presenting a solution, characterised in that the pole is equipped with a flexible handle at a certain angle to the pole shaft, whose handgrip, i.e., the handle part, onto which the entire hand is meant to grip, forms a backwards-downwards opening, circa 45- to circa 65-degree angle to the pole shaft that preferably has a straight profile and is in an upright position in the walking direction, in which the smaller angle represents the tensioned position of the handle and the larger angle the resting position of the handle, which handle forms a circa 70- to 90-degree, backwards-upwards-opening angle to the vertical line when the poles are in the position where the arms are hanging straight along the body's sides with the hands gripping the handles and with the pole shaft straightened backwards and the pole tips leaning against the ground when the pole shaft's length has the length determined for a flexing pole, i.e., reaching from a person's toes up below a person's lowest costal arch, and the handle at the above-mentioned angle functions as an efficient lever with high flexing resistance, i.e., a 20-80 kg, generating a pushing force in the pole shaft both downwards and backwards, which is greater than a traditional straight handle's pushing force, and, when walking on a hard surface, its flexible handle also functions as an efficient shock absorber for the pole spike, and the handle's angle to the shaft and the pole's length provide the pole with a sharper pushing direction to the surface, ensuring an efficient surface grip for the flexing pole.

One of the unique properties of the flexing pole is its spikes' and lower parts' surface and ground grip caused by the handle's push direction both backwards and downwards. The downward-pushing force ensures that the pole tip effectively grips the surface. But the precondition for this is that the flexing pole's length must be shorter than that of a traditional Nordic walking pole, as the traditional Nordic walking pole's suitable length is defined so that, when a person stands with the pole handle in the hand, the forearm is at a 90-degree angle to the rest of the arm. The length of a flexing pole must be shorter, because the pole's too gently sloping angle to the ground would eliminate the pushing force downwards, which is realised through a handle working as a lever, provided that the pole shaft, i.e., the spike, is at a steeper angle to the surface. Hence, the length considered suitable for a flexing pole is defined so that, when a person stands erect, the pole reaches from the ground up below a person's lowest costal arch.

In case the handle's angle to the pole shaft is too large, e.g., 90 degrees, the pole lacks one of the most important technical properties for correct pole walking.

In case the angle is too large, the following will take place. At the beginning of the pushing phase, when gripping the handle, the wrist gets into an unfavourable downwards bending angle that is unfavourable for the wrist's force transfer, causing the wrist to get tired and sore.

One of the most important preconditions for functioning pole walking is the natural pendulum motion of the poles, which provides the pole tip with the lifting needed when the movement starts from the back position. If the handle's angle is correct, at the beginning of the movement, the handle pulls the pole tip upwards, and, unobstructed, the pole tip moves forward without touching the surface. If the angle is too large, the pole tip does not come up from the ground and, during the beginning phase, remains in the back dragging unpleasantly along the ground. This important lifting of the tip is proportional to the handle's angle to the pole shaft and, if the angle is too large, it is entirely eliminated.

A handle with too large an angle not only eliminates the lifting of the tip, it also easily throws or pushes the pole too far past the person's legs in the front at the end of the pendulum motion, whereupon the pole's position is directed slantingly forwards, from which position it is impossible to start the pushing phase with a walking pole.

But, the handle's angle to the pole shaft must also not be too small, in which case the handle's resting position is too low and the wrist no longer turns downwards, i.e., pushes downwards from the position. This means that the handle's functioning as a lever is eliminated, and the handle's functioning is simplified to function as a traditional straight handle. When the handle and the pole shaft move side by side, the handle's mobility is entirely eliminated. A flexible handle's efficient functional sector can be accurately defined with an angle to the pole shaft alternating between circa 65 and circa 45 degrees, with the 65 degrees forming the handle's resting phase and the 45 degrees the most tensioned phase, which is defined according to the wrist's physiological structure that restricts the wrist's effective trajectory within a certain sector.

The handle's pushing force is proportional to the handle's tension, which pushing force is at the highest when the handle is at a ca. 45-degree angle to the pole shaft. Rhythmic walking movement as well as good physical condition are sought through minor resistance, and, in addition to the increased physical condition, especially upper body and arm muscle mass can be increased with high resistance, i.e., 45-80 kg.

Traditional walking sticks i.e. canes are much shorter than the Nordic walking poles and their handles are at a large angle to the shaft. This is necessary for a walking stick, because the stick is short and the weight of the hand and support onto the handle is relatively directly generated from above, whereupon a too small angle would not provide the desired support. At the beginning, the stick tip does not need lifting in the back because the stick's motion pattern lacks the push backwards, but, instead, a flexible 90-degree angle downright kicks the walking stick to the front of the body's vertical line, from where it would be impossible to push backwards. But, as the series of movements in the walking stick completely lacks the phase to push backwards, there is no limit for the walking stick as to how far to the front it is possible to move it. After the walking stick is moved to the forward position, it remains in that place until the person continues walking up to the point where the walking stick tip has slightly passed the body's vertical line, at which time the walking stick is again moved to the front. Hence, when walking with a walking stick, the series of movements only includes the moving of the stick to the front, from where a person's advancement again automatically moves it backwards.

A known technique is represented by five cases, FI 8924 (Hautala Antti), U.S. Pat. No. 6,491,323 (Kustritz James), U.S. Ser. No. 10/098,424 (Husted Royce), U.S. Pat. No. 7,445,016 B1, and KR 100991485 B1. FI 8924 has fastened onto the side of the actual straight handle a hand-press strengthening the fingers onto which the fingers can grip during walking and press to the direction of the pole shaft with resistance provided by a torsion spring fastened both onto the finger press and onto the pole shaft end. In theory in this solution, it is possible to use the smaller, narrow finger press as the handle, but, as its only purpose is to strengthen the user's fingers, the patent application does not include any mention thereof. But, in practice, the use of a press as the handle does not work, as, first of all, the press is far too fragile to serve as a sturdy handle and its resting angle to the pole shaft is circa 10 to 20 degrees for the fingers to comfortably reach around the press, which entirely eliminates the use of a press as a lever, i.e., there is not enough space for bending towards the pole shaft, which is the entire idea in the flexing pole. Consequently, a press handle can only function similar to a traditional handle, i.e., it can only be pushed to the direction of the pole shaft's length. Pushing downwards is not possible, because then the whole pole would move at the same time cross-directionally downwards, eliminating the entire pushing force. A professional must have thought about this, which probably is the reason why the mentioning of the use of the press as a flexible handle is entirely missing from the patent application. U.S. Pat. No. 6,491,323, Kustritz James, equipped the Nordic walking pole with an additional handle, whose purpose is to provide additional length to the pole and boost to the end push with an additional handle hinged onto the pole's actual handle end, which, during the initial push, remains rigid and parallel to the actual handle but, in the middle of a push backwards, opens and forms an opening angle to the pole shaft or to the actual handle reaching 160 degrees during the end push, at which time the pole has elongated with the length of the additional handle, providing the skier with a longer pole push. The additional handle automatically retrieves to the initial position with the spring force. It can be speculated whether the invention in question, i.e., the flexible handle, could be a self-evident solution to a professional in light of this known technique, especially when focused on the solutions by Hautala and Kustritz.

Both have an additional handle, but neither one of them aims at a flexible handle for pushing and damping purposes. In their own way, both are functional solutions, the other one has an additional handle strengthening the fingers, and the other one provides an additional boost for a skier with a hinged solution, where a flexible handle would atone its force, so it is incomprehensible why, based on these functional solutions, somebody would think of another solution, in which the aim would be to attenuate the pole's pushing resistance with a flexible or yielding handle. But, when considering this issue from the perspective of shock absorption, several lengthwise flexing telescopic shaft and other shaft solutions using this known BungyPump-like technique exist. U.S. Ser. No. 10/098,424 (Husted Royce) invented a solution, in which the flexing takes place with the help of a bisectional shaft that opens up like a bow under stress, but the solution has nothing to do with a flexible handle.

But one asks, why it is not possible to find among the known technique a functioning flexing walking pole similar to the flexing pole in question. Because a functioning solution requires more than a flexible handle attached onto the pole shaft. The handle's correct fastening angle to the pole shaft and the flexible pole's correct length and the handle's shape or design are extremely important, and even minor deviations entirely change the technique that makes the pole into a correctly functioning flexible pole. Below, the handle's special design is illustrated before the claim.

For the flexing pole invention in question to be successful, there were two reasons why its invention required hard work and a lot of empirical efforts. First, the invention is new and, therefore, has never before been tested. And second, the field of healthcare is very demanding and, hence, the task to create an entirely technically new walking pole was not easy.

For example, the empirical tests to create a knew flexing Nordic walking pole revealed that the angle between the handle and the shaft was extremely important for the well-being of the pole walker's wrists, hands, and arms. The use of wrong technical pole specifications made it impossible to walk longer distances. Every joint and muscle began aching, and the work for the optimal pole continued by focusing on the right angles. In the end, when the optimal solution was achieved, we were able to establish, that the optimal technical solution lays within a very narrow space, and even small divergences from the functioning specifications had a great effect on the invention's functional behaviour and, thus, also on the user.

With this, I want to say that, were it so that the invention in question would not lack novelty and that the prior creations would represent inventions that consist of somewhat similar types of parts than those in the invention in question but would be fastened in a technically different way, it is difficult to believe that anyone, even a professionally skilled person, would see the flexing pole in question as a self-evident solution. It must be stated that, for a good reason, this new flexing pole with its technical details is far from any self-evident solutions.

The Nordic walking pole was created in Finland in the 1970s and diligent search for the Nordic walking pole's own new identity and profile has taken place since. Nordic walking has been studied, and it has proven to be a surprisingly comprehensive and healthy exercise form for people. Traditional Nordic walking poles do not differ from other poles, and the struggle to find the pole's own identity has continued for more than 40 years. Professionals have tried to find improvements for the pole which would rise the Nordic walking pole up to its own class to stand out among the other poles. The era of electronic data sources has enabled access to all existing databases that include the known technology, but, nevertheless, it lasted over 40 years until a new walking pole with its own design and identity was born in the shape of the flexing pole invention in question. Had the solution been easy and self-evident, the flexing pole would have been a part of our exercise equipment already for a long time.

Instead of the Nordic walking pole, the other US solution 7445016 deals with a walking stick, whose angles are not suited for the Nordic walking pole.

KR 100991485 invented a solution, in which it is possible to make the handle tense by pressing with a hand, and when the pole is lifted from the ground releasing the tension in the handle, the pole shaft flings forward, this way facilitating the pole's functioning. The intended purpose of flexing is not to atone, and the handle in no way functions as a lever. Both solutions also lack the handle's correct angle to the pole shaft required for Nordic walking. In other words, based on the facts presented above, this is not a Nordic walking pole, it is a walking stick, hence, its appearance differs relatively little from the Nordic walking pole, but the minor technical, decisive differences between the Nordic walking pole and the walking stick make them both exercise equipment functioning in a completely different way, the walking stick being an aid and the Nordic walking pole an exercise and training equipment.

The basic structure of the Nordic walking poles in the market is that of the ski poles. The pole shaft is straight or somewhat bent, and there is a handle on the pole's top end and a supporting loop or strap for the wrist fastened onto the handle. A steel spike grapping the ground is fastened onto the bottom end, onto which it is possible to slip a rubber cap for a hard surface. The Nordic walking pole does not have the ski pole's basket for snow. For understandable reasons, the shock absorber solution found in the Nordic walking poles is not to be found in the ski poles.

Today's Nordic walking pole lacks the right flexing for eliminating the hardish shock and vibration on the pole shaft when the pole tip hits a hard surface represented by regular road surfaces. In the long run, this vibration may create tissue and joint damages that may turn into chronic pain, if pole walking continues year after year.

The above-mentioned BungyBump solution in the market that has a telescopic shock absorber providing lengthwise absorption for the pole shaft which entirely eliminates the pushing resistance important for the pole cannot be considered to be classified as a traditional Nordic walking pole.

Another disadvantage in the Nordic walking pole is the handle's wrist strap that supports the correctly performed transfer of force in pole walking and bends the wrist upwards when the strap tightens especially during the important end push, at the time when the purpose is for the arm to straighten behind the back. During the end push, the wrist strap forms the steepest angle at the thumb root which, in the long run, may also result in a repetitive strain injury. As the complete straightening of the arm is considered difficult to perform, the important end push of the pole often remains incomplete.

However, as a too tight grip on the handle makes the fingers freeze during winter, the pole's wrist strap is essential for avoiding the tiring and numbing grip of the fingers on the handle during long walks and runs. When using a strap, it is possible to loosen the grip on the handle between the pushes and move the fingers, but, for the aforementioned reasons and simply for practical reasons, dabbling with the straps is not pleasant for everybody. For many, the fitting and tightening of the straps to fit the hands is a child's play, but, for different reasons, for many others, it is difficult. So difficult that many people do not buy the poles or use them without the strap, where the pressing of the handles strains the fingers and removes the possibility for an effective end push.

The invention presented here removes all the problems emerged by equipping the pole with a handle, whose flexing direction is at an angle to the pole's pushing direction, whereupon the flexing does not affect the pole's pushing resistance in the same way as a telescopic shock absorber affects it. The flexing downwards towards the pole shaft effectively absorbs the vibration and shock feelings in the wrist, which flexing also makes running with the poles naturally pleasant.

The handle is implemented so that the handle part onto which the hand grips forms a backwards—downwards opening, circa 45- to circa 65-degree angle to the pole shaft that preferably has a straight profile and is in an upright position in the walking direction, in which the larger angle represents the handle's resting position.

For the lifting of the pole tip with the handle to be effective, the distance between the pole shaft and the handle's top end must be as small as possible when the pendulum motion starts behind the body. For achieving the upthrust, a too large gap makes the hand rise high, whereupon the hand tires and the natural pendulum motion is not realised. The hand is not lifted, and the pole tip keeps dragging along the ground. To avoid this, the handle must be directly, not indirectly, fastened onto the pole shaft through a flexible part. In order to realise the pole shaft's small gap, the pole handle's form preferably is that of a traditional straight handle that does not restrict the handle's free, i.e., back end's design to curve downwards. The curve can excellently bend backwards, fastening onto the base of the handle before the flexible fastening location. The supporting loop must curve so far down that it does not obstruct the hand gripping. The location of the flexible part is either on the side of the pole shaft or as an extension of the shaft's top end or on the back of the handle, which last solution also requires that the handle's base end is movably fastened onto the pole shaft, e.g., with an axis between the handle and the shaft. Regardless of the location of the flexible part, if the handle's flexible part alone does not provide enough lateral support, an axis between the shaft and the handle base is required. In case the solution also needs an axis in addition to the suspension, the location of the suspension can be separate from the axis, but also threaded onto the axis. The suspension in the handle's back end can be realised in two ways. Either with a separate spring whose other end starts from the handle's back end or from below the supporting loop and the other end is anchored onto the pole shaft in the location of the reinforcement designed for the purpose.

Another solution is that the back end suspension is formed from the back end extension integrated into the handle and the back end made of the handle's flexible material is designed as a suspension functioning like a leaf spring that preferably curves diagonally forward towards the pole shaft and fastens onto the shaft either with a sliding or solid fastening.

The leaf spring and the torsion spring are excellent examples of the forms of suspension in the handle's front end, of which, as an integrated solution, the leaf spring in its different forms is excellently suited as a part of the handle's own frame, in which the flexible part is realised by making the handle's own material into a lighter, flexible leaf-spring-formed part. In case the flexible part is an actual detached leaf spring, in order to ensure the lateral support needed, for the fastening between the handle and the shaft, it is preferable that the leaf spring is connected to the fastening of the axis. This way, the leaf spring can go around over or below the axis to be fastened onto the handle and pole shaft.

The torsion spring can represent the most preferable form of a separate suspension, in which the torsion spring's coil functions as the flexible piece, and the torsion spring's other end is anchored onto the pole shaft and the other end onto the handle's top end, i.e., base. In order for the fastening of the torsion spring ends to be durable, e.g., when fastened in the mould during casting, it is preferable to turn the torsion spring ends into minor curves and forge the ends flat, so that the fastening firmly grips onto the torsion spring ends.

The torsion spring's own stability does not call for any additional support in the form of an axis or a similar part. Instead, without any additional support, the torsion spring itself is the most preferable flexible part between the handle and the pole shaft.

There is yet another way to realise the suspension in which the pole shaft has a flexible as straight as possible extension part between the handle and the shaft.

A flexible pole can also be used in the traditional way by fastening a flexible handle onto a traditional handle already existing in the pole shaft, either onto its top, side, or base. When the desire is to change walking with a flexible handle into traditional Nordic walking, the shaft is turned 180 degrees, whereupon the other handle on the opposite side can be used. When a flexible handle is fastened onto the base of a traditional handle, it is not necessary to make a 180-degree turn with the pole shaft when the change between the handles takes place. This is to say that the changing of the grip from a traditional handle to a flexible handle can be made instantly, simply by changing the grip on the handle.

In order for the pole's ground grip to hold in both directions, the dual-handle solution requires a dual spike at the bottom end. The preferable form of the spike is that of a salmon tail, in which there are two tips opposite to each other pointing backwards diagonally down. But, the fastening of a flexible handle onto the pole shaft through the bottom of a traditional handle eliminates the need for a dual tip.

When talking about the form of the handle, to avoid the generation of a too large a gap between the handle's attachable end and the pole shaft, it has already been stated how important it is that the upper end of the handle is as straight as possible. Less rigid rules apply to the handle's back end, i.e., the bottom end, and it is preferable that they allow a downwards curving form for the handle's back end, this way preventing the hand from slipping out of the handgrip. It has already been stated above that the handle's bottom end can preferably continue below the actual handgrip as a curve up to handle's front end, where it fastens onto the pole shaft before the flexible fastening location. Such a closed, oval-shaped handgrip provides additional support for the handgrip, but, on the other hand, rises the pole's production price.

The handle's lateral stability can be improved by extending the downward curving part at the handle's end to pass the pole shaft on both sides of the pole shaft with a V- or U-shaped handle end, whereupon the sides of the V- and U-handle ends support the handle against the push from the side. The ends of the U-shaped handle end can be closed to envelope the pole shaft, whereupon the handle's direction upwards is also closed.

The walking/running/exercise poles are also very preferably used as gymnastics and break exercise equipment whereupon they are taken and swung to different directions on the side of the body and over the top of the head. It is also possible to develop a counter force for the body with the flexible pole enabling efficient and total strengthening of a person's core, especially the deep back and abdominal muscles. The exercise is performed so that the poles are placed to point slantingly forward with the tips well anchored onto the base, thereby holding the pole tips firmly in place. Then, keeping the back straight, the person leans forwards with straight arms and holds himself or herself standing against the handles suspended with the spring. Not to fall forwards, the person must tense both the abdominal, back and arm muscles. When starting the exercise, depending on the person's muscular condition, the load of the exercise can be adjusted by stepping closer or farther from the pole tips.

When considering this exercise, an especially preferable handle solution that both increases the hand's comfort when holding the handle and laterally stabilises the handle is created with a widened handle that covers the entire open palm from the back edge of the fingers' base joints all the way to the middle over the thumb base muscle. The handle extends downwards to the palm edge and over it with a projection that begins from the base of the little finger extending side by side with said little finger in straight position and extends up to the middle of said little finger. The handle's outer edge, extending from the base of the projection along the side of the palm edge through the palm boundary at the wrist and to the thumb base muscle, forms a circa 1-2 cm high wide edge that supports the hand and wrist both back- and downwards and laterally. The projection also stabilises the hand laterally and prevents the hand's slipping from the handle. For its part, the handle's wide part under the thumb muscle prevents the hand from turning inwards. The handle is fastened to such a position in respect of the pole shaft that the part of the handle between the thumb muscle and the projection's base forms a line, i.e., a slanted level, creating a circa 40- to 70-degree downward, projection-directional angle to the pole shaft. For the thumb muscle to be optimally supported, the middle of the handle is slightly arched conforming to the hollow of the hand and the wide part supporting the thumb muscle is convex. Except for the rising outer edge area and slight rise and fall in the curved and convex areas, the handle's lateral profile is straight and low. Compared to a straight handle, the push force provided by a wide handle is considerably larger, because a wide handle provides a large push force through the entire hollow of the hand, and the push force is in the direction of the wrist, not at an angle to the wrist, which is the case for the traditional handle.

The pole can be equipped with a flexibility control, in which, for instance, a spring is equipped with a tension screw or the flexible piece is equipped with a rigidity control, in which it is possible to make the flexible part more rigid with a moving rigid cover.

It is self-evident that it is also possible to use then flexing pole for skiing. But when skiing, there are detailed rules for using flexible equipment. Consequently, skiing with the flexing poles can be considered as a new form of skiing, at its best bringing new joy to skiing.

The following is a presentation of the invention, with references to the appended drawings where FIG. 1 presents a pole solution, in which a flexible handle is fastened onto a traditional handle with a torsion spring.

FIG. 2 presents a pole that has a handle equipped with integrated flexing fastened onto its shaft.

FIG. 3 presents a solution, in which the flexible part is placed onto the pole shaft's top end before the handle.

Figure 4:
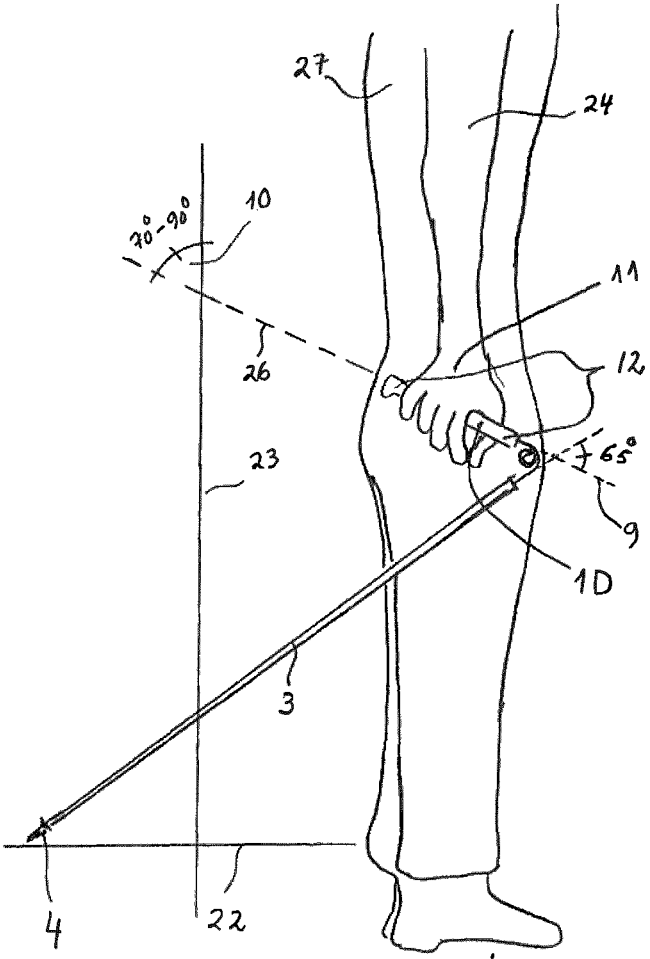

FIG. 4 presents the shaft's angle to the vertical line of a pole shaft hanging in a straight arm's handgrip along a person's side as the pole tip touches the ground behind.

Figure 5:
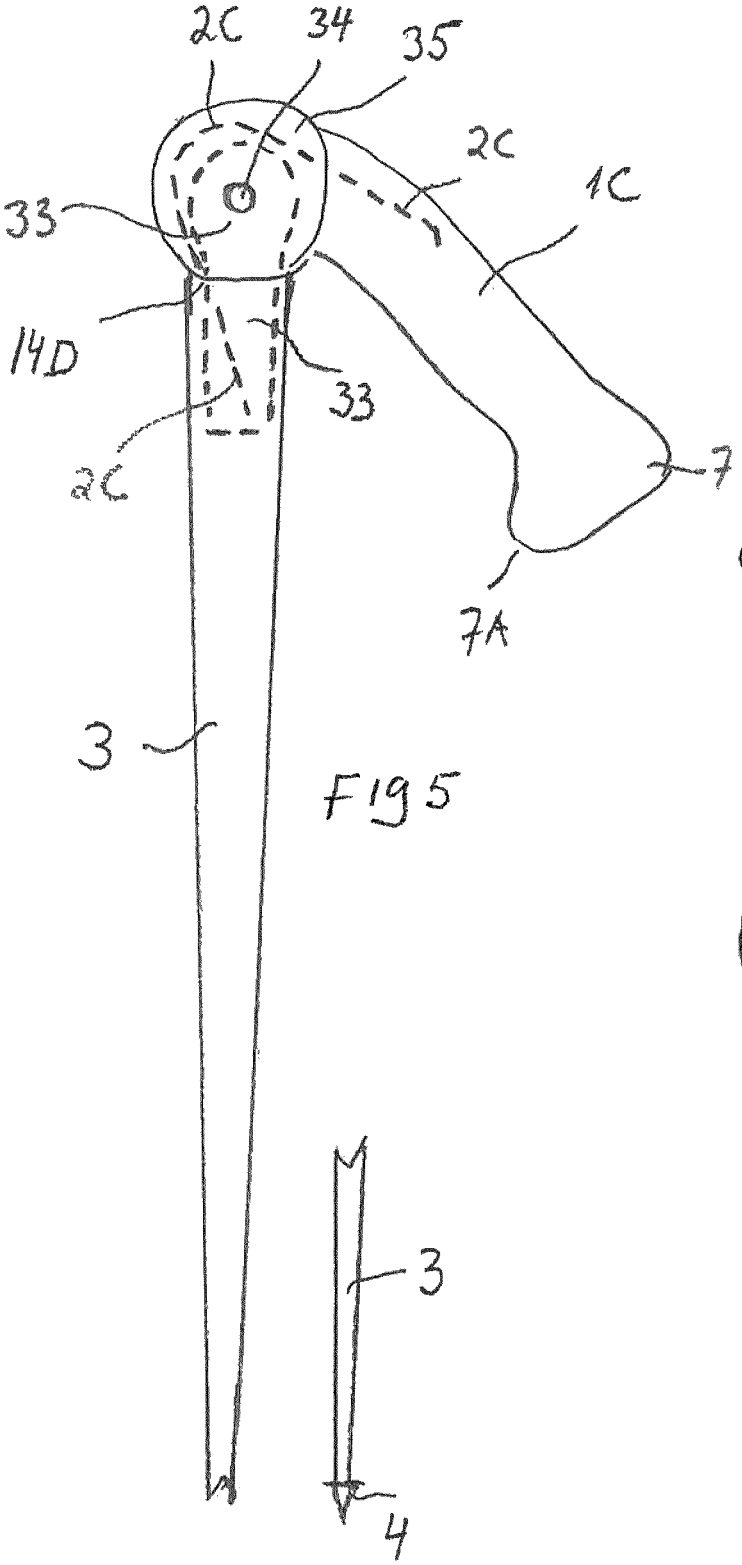

FIG. 5 presents a separate spring solution joining the handle and the pole shaft with a leaf spring, in which the handle is hinged with an axis onto the additional part fastened onto the top of the pole shaft.

Figure 6:
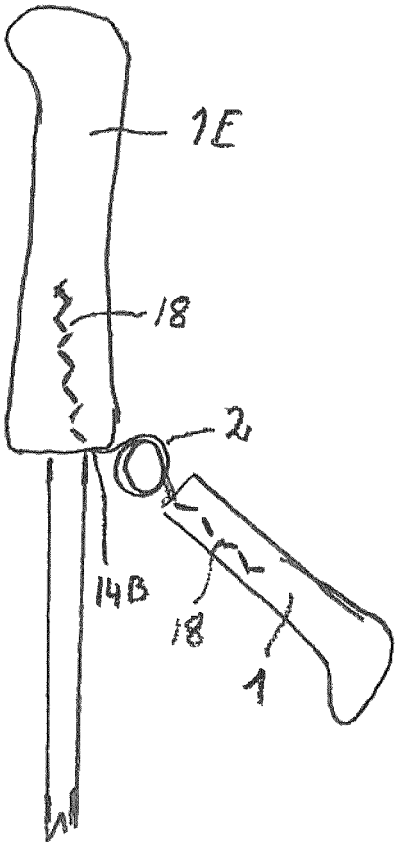

FIG. 6 shows how a flexible handle is fastened onto the base of a traditional handle.

Figure 7:
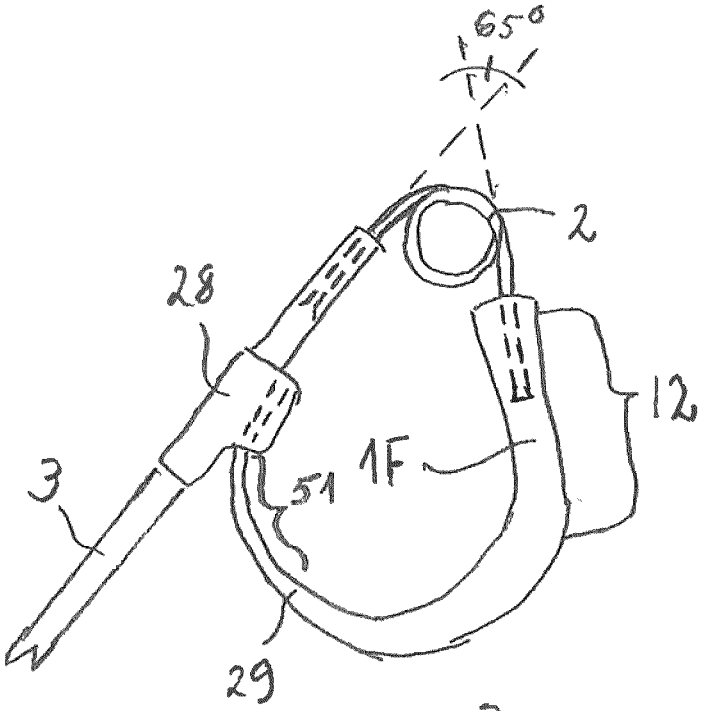

FIG. 7 presents a solution, where, due to its thin form, the curved back end extension of a handle made of flexible material is flexible and fastens onto the pole shaft in the location reinforced for the purpose.

Figure 8:
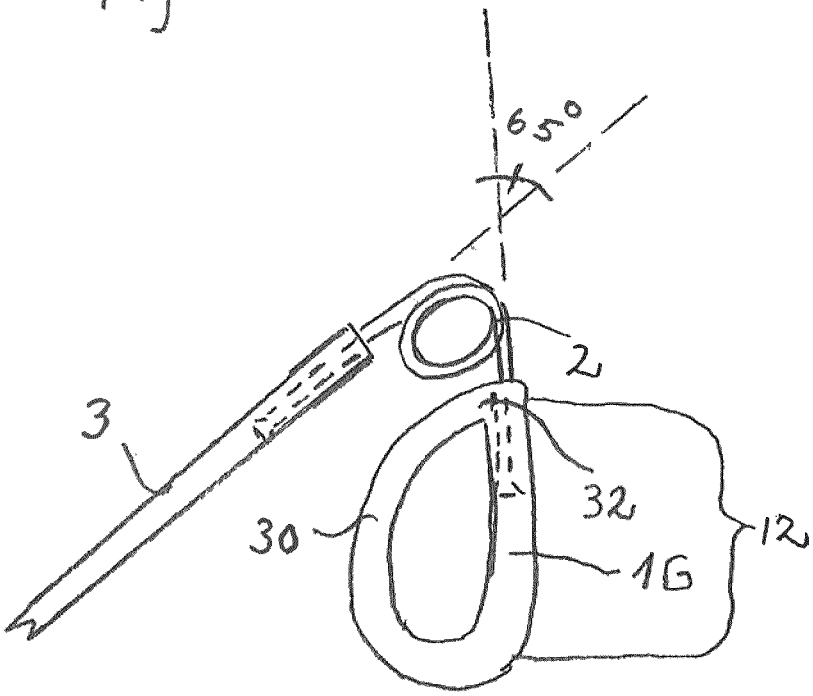

FIG. 8 presents a handle solution, in which the actual handgrip continues in a curved form back forwards, forming a supporting loop running under the actual hand-held handgrip and the supporting loop is fastened onto the base of the actual handgrip.

Figure 9:
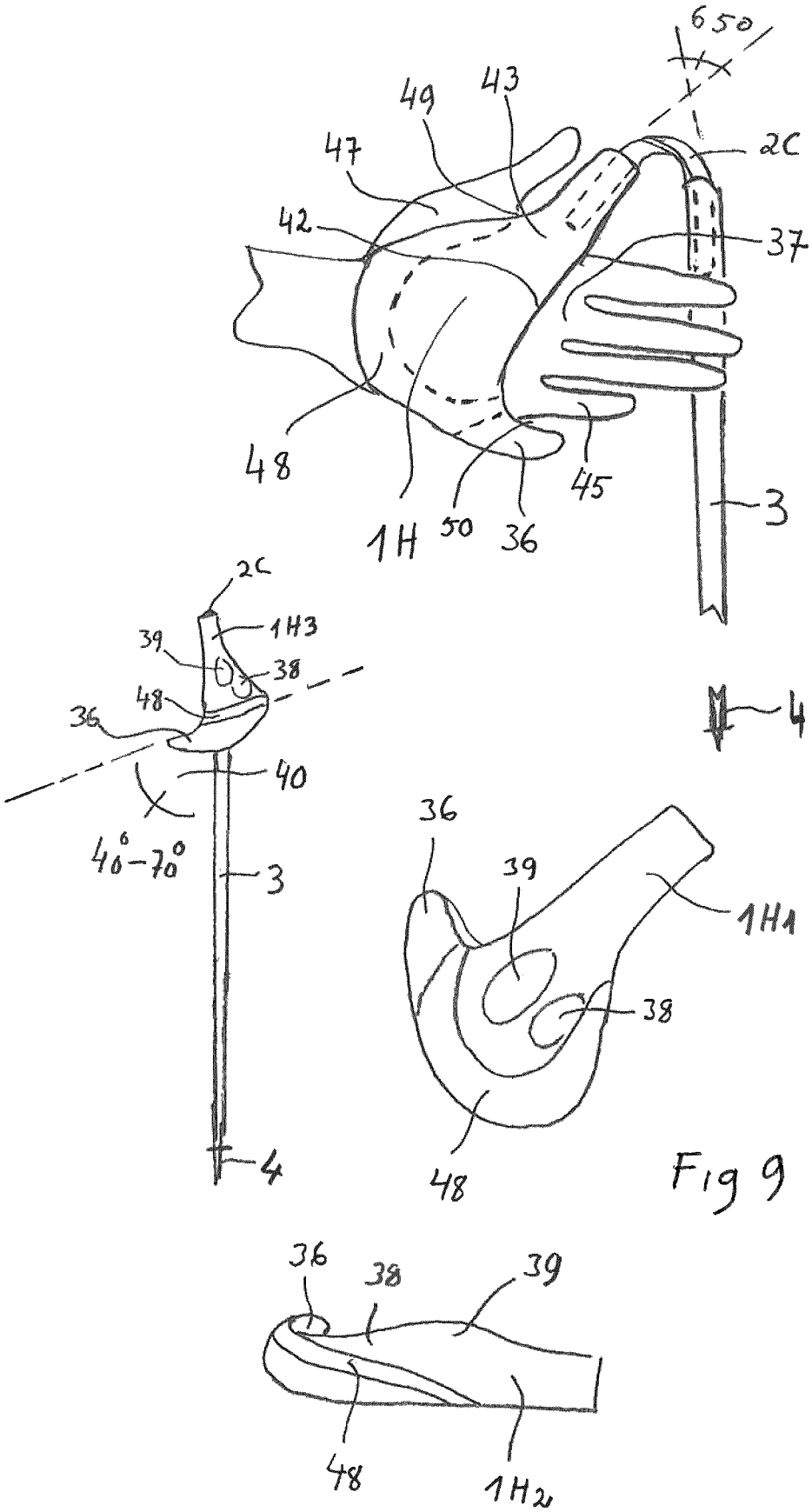

FIG. 9 presents a wider handle equipped with a higher edge area and a projection which higher edge area laterally supports the hand and the projection prevents the handle from slipping out of the hand.

FIG. 1 presents a solution, in which a flexible (13, 17) handle (1) is fastened with a torsion spring (2) at a 65-degree angle (9) onto the top (14C) of a traditional handle (1E) located on the pole shaft (3). There is a support strap (8) for the wrist in a traditional handle (1E). The flexible handle's (1) bottom end tip (7A) curves into the direction of the pole shaft (3). The pole shaft's (3) bottom end's (16) tip is formed of a salmon-tail-like double tip (5). The rubber cap (6) for a soft surface with which it is possible to cover the tip spikes (5) is shown on the side of the pole shaft (3).

FIG. 2 presents a flexible handle (1A) that has a flexible part (2A) integrated into it, which flexible part is fastened onto the pole shaft's (3) top (14). The tip (7A) of the handle's (1A) bottom end is designed to curve towards the shaft (3).

FIG. 3 presents a solution, in which a flexible part (2B) is fastened as an extension onto the pole shaft (3) which flexible part (2B) connects the pole shaft (3) and the handle (1B).

FIG. 4 presents a backward- and diagonally-upward-opening 70 –90 degree angle (10) to a vertical line (23) formed by a handle (1D, 12) in the hand (11) of a straight arm (24) hanging a person's side (27) when the pole tip (4) touches the ground (22) behind.

FIG. 5 presents a separate spring solution with a leaf spring (2C), whose other end is fastened onto the handle (1C, 35) and the other end onto the pole shaft (3, 14D) and onto the pole shaft's (3) additional part (33), in which solution the handle (1C) is rotatingly fastened with an axis (34) onto the pole shaft's (3) additional part (33).

FIG. 6 presents a solution, in which a flexible handle (1) is fastened onto the pole shaft (3) with a torsion spring (2) through a traditional handle's (1E) base (14B, 18).

FIG. 7 presents a solution, in which, due to its thin form, the curved back end (29, 51) of the handle (1F) made of flexible material is flexible and fastens onto the pole shaft (3) in the part (28) reinforced for the purpose.

FIG. 8 presents a pole handle (1G) equipped with a supporting loop (30) fastened onto the base (32) of the handle (1G) and located under the handle (12, 1G).

FIG. 9 shows a wider handle solution (1H, 1H1, 1H2, 1H3)) that covers the entire hollow of the hand (37) and laterally supports the hand and the wrist with a higher edge area (48) extending from the base (50) of the little finger (45) all the way to the thumb's base joint (49), which handle (1H, 1H1, 1H2, 1H3) has a projection (36) that prevents the handle (1H) from sliding out of the hand. There is an arched centre (39) conforming to the form of the palm and a concave area (38) conforming to the thumb muscle (47) shown on the palm-side level of the handle (1H1). The 40- to 70-degree angle (40) to the pole shaft (3) formed by the handle's slanted level (41) is shown in a perspective (1H3) illustrated directly from the back. Except for the arched (39) and concave (38) areas nestled into the hollow of the hand and the thumb muscle (47) and the rising edge area (48), the handle's side profile (1H2) is straight.

The description and the related figures are only intended for illustrating the concept according to the invention. The details of the Nordic walking/running/exercise pole according to the invention may vary within the framework of the claims.

The invention claimed is:

1. A Nordic walking/running/exercise pole, comprising a flexible handle that is at a certain angle to a pole shaft, and wherein a handgrip of the said handle forms a backwards-downwards opening, circa 45- to circa 65-degree angle to the pole shaft that has a straight profile and is in an upright position to the walking direction, which angle's higher degree represent the handle's resting phase and the lower the most tensioned phase, which part of the handle held by a user's hand forms a backwards and upwards-opening, circa 70-90 degree angle to the vertical line when the pole is in the position where the user's hands are hanging with straight arms along the sides of the user's body with the handle in the hands and the pole straightened backwards with the tip leaning against a surface, the pole having its characteristic length from the user's toes up to below the lowest costal arch, in which way the handle at the aforementioned angle functions as an lever with a flexing resistance, circa 20-80 kg, generating a pushing force both downwards and backwards in the pole shaft, and, when walking on a hard surface, the flexible handle also functions as a shock absorber for the pole spike and both the handle's angle to the pole shaft and the pole's length provide a pushing direction, allowing the pole tip a surface grip;

wherein the handle's flexible bending takes place either in the handle's own integrated part or in a separate flexible part joining the handle and the pole shaft, where the fastening of the handle onto the pole can be realised at the pole shaft's end or side, at a traditional handle's top, or at a traditional handle's base, and the hand-held part of the handle has the form of straight handle and a widening at the back end that prevents the handle from slipping out of the user's hand and operates as a flexing stopper against the pole shaft, which pole shaft's tip is equipped with at least one steel spike.

2. The Nordic walking/running/exercise pole according to claim 1, wherein the handle can flex from an initial position all the way up to the pole shaft, wherein a curved end of the handle's extended back end functions as the flexing stopper, and, in regular walking, circa 2-3 cm of the flexing capacity is used, but in cross-country running up and down hills, in which the flexing also functions as a buffer, the flexing length can be up to threefold compared to the flexing length in regular walking.

3. The Nordic walking/running/exercise pole according to claim 1, wherein the handle forms an oval-shaped closed ring in which the handle's bottom side is formed from a supporting loop, whose front end is fastened on the base of the handle.

4. The Nordic walking/running/exercise pole according to claim 1, wherein the handle's back end continues as a curved part functioning either as the handle's integrated flexible spring or as a separate flexible spring fastened onto the handle, curving downwards and fastening onto the shaft part designed for the purpose.

5. The Nordic walking/running/exercise pole according to claim 1, wherein the pole has a wide handle that longitudinally covers the entire open palm from the edge of the user's fingers' base joints all the way over the user's thumb base muscle's edge and cross-directionally from the area between the user's thumb and the forefinger finger all the way to the side of the palm along the edge area bordering the user's wrist and passing it with a projection extending side by side with the straight little finger up to approximately the middle of said finger laterally supporting the hand and preventing the sliding of the handle, and the handle's outer edge from the projection's base all the way to the thumb base joint is raised by circa 1-2 cm, which raised edge laterally supports the hand, and the projection and the raised edge area form a slanted level that creates with the pole shaft a circa 40- to 70-degree angle opening downwards towards the pole end in line with the projection, which handle's wide part in the middle is slightly convex and slightly concave at the user's thumb base muscle, conforming to the palm's physiological form, and, except for the raised edge area and the slight rise and fall in the convex and concave areas, the handle's side profile is straight, which handle is attached onto the top of the shaft with a 2 mm thick and 1 cm wide leaf spring.

* * * * *